US006116480A

United States Patent [19]

Dufort

[11] Patent Number: 6,116,480

[45] Date of Patent: Sep. 12, 2000

[54] POWDER DISPENSING SYSTEM

[76] Inventor: Michel Dufort, 2262 Annette, Mascouche, Québec, Canada, J7L 1C8

[21] Appl. No.: 09/069,293

[22] Filed: Apr. 29, 1998

[51] Int. Cl.[7] ..... B05B 7/14

[52] U.S. Cl. ..... 222/637; 239/654

[58] Field of Search ..... 401/185; 406/151, 406/152, 153, 117, 122, 171; 239/654, 143, 142, 99; 222/637, 152

[56] References Cited

U.S. PATENT DOCUMENTS

| | | | |
|---|---|---|---|
| 3,133,833 | 5/1964 | Giaimo, Jr. | 222/637 |
| 4,896,833 | 1/1990 | Brody | 239/654 |
| 5,213,271 | 5/1993 | Uribe et al. | 239/654 |
| 5,779,161 | 7/1998 | Dvorak | 222/637 |

FOREIGN PATENT DOCUMENTS

| | | | |
|---|---|---|---|
| 403219 | 1/1932 | United Kingdom | 401/185 |

*Primary Examiner*—Kevin Shaver
*Assistant Examiner*—David Deal

[57] ABSTRACT

A powder dispensing system which comprises a powder dispensing section, a powder collection section and a connecting section extending therebetween, and fan means operative to draw air from the powder dispensing section to the powder collection section through the connecting section. The powder dispensing section has a container for holding a supply of powder material with a housing extending thereabout and preferably a pair of access apertures to permit the hands of a user to gain access to the powder material. The powder collection section has a housing with an air outlet therein and filter means associated with the air outlet. The powder dispensing system may be used for dispensing magnesium powder for gymnasts while preventing environmental contamination of the surrounding locale.

13 Claims, 2 Drawing Sheets

POWDER DISPENSING SYSTEM

BACKGROUND OF THE INVENTION

The present invention relates to the field of powder dispensing systems and is particularly concerned with a device for dispensing powder material while reducing the contamination of the surrounding air.

There exists a plurality of situations wherein it is desirable to allow access to an intended user to a given volume of powder material. One common example of such a situation relates to the field of indoor sporting activities. Indeed, powder material typically in the form of magnesium powder is commonly used by gymnasts or the like to increase the friction coefficient between the hands of the gymnast and the gymnastic apparatus on which the sport is being performed.

The conventional method of dispensing magnesium powder for gymnasts consists in providing an open top receptacle into which the powder is dispensed. When required, the intended user merely grabs a handful of powder and distributes the powder over the skin surface of both hands.

This conventional method suffers from at least two major drawbacks. Indeed, since the powder is dispensed using an open container, some of the powderous material is dispersed in the surrounding air thus polluting the latter and enhancing the risk of inhaling potentially harmful particles. Second, some of the powderous material often falls out of the receptacle particularly when it is being grabbed by an intended user thus leading to unnecessary waste of often expensive powderous material. Accordingly, there exists a need for an improved powder material dispensing system.

SUMMARY OF THE INVENTION

It is an object of the present invention to provide a powder dispensing system that is specifically adapted to dispense powderous material in an ergonomical fashion.

It is another object of the present invention to provide a powder dispensing system that reduces the amount of powderous material dispersed through the adjacent environment.

It is a further object of the present invention to provide a powder dispensing system that is conform to conventional forms of manufacturing, be of simple construction and easy to use so as to provide a powder dispensing system that will be economically feasible, long lasting and trouble free in operation.

According to one aspect of the present invention, there is provided a powder dispensing system comprising a powder dispensing section, a powder collection section, a connecting section extending between the powder dispensing section and the powder collection section, and fan means operative to draw air from the powder dispensing section to the powder collection section through the connecting section, the powder dispensing section comprising container means for holding a supply of a powder material, a housing substantially enclosing the container means, and access means to permit access to the powder material by a user, the powder collection section comprising a powder receiving area, a housing substantially surrounding the powder receiving area, an air outlet in the housing, and filter means associated with the air outlet.

According to a further aspect of the present invention, there is provided a powder dispensing system comprising a powder dispensing section, a powder collection section, and a connecting section extending between the powder dispensing section and the powder collection section; the powder dispensing system comprising container means for holding a supply of a powder material; a housing substantially enclosing the container means, first and second access apertures formed in the housing to permit access to the powder material by a user, each of the access apertures being sized to permit the passage of a user's hand; the powder collection system comprising a powder receiving area; a housing substantially surrounding the powder receiving area, an air outlet formed in the housing, a fan mounted proximate the air outlet to blow air outwardly from the housing; filter means mounted between the fan and the powder receiving area.

The powder dispensing system, in a preferred embodiment, has fan means which comprise a fan mounted in the powder collection section proximate the air outlet. It is also preferred that filter means be interposed between the fan and the powder receiving area.

The powder dispensing system, as aforementioned, has access means to permit access to the powder material by the user. In a preferred embodiment such as is suitable for use by gymnasts, the access means may comprise a pair of apertures each sized to permit the passage of a user's hand therethrough.

Preferably, the system will include switch means operatively connected to the fan to permit selective operation thereof—to turn the fan on or off as required. Alternatively, an automated system may be utilized wherein a sensor would sense the presence of the user's hands to turn the fan on or off.

The system will also preferably include visual indicating means to indicate when the fan is operative. Many conventional visual indicating means may be employed such as LEDs or the like.

Preferably, the powder collection section will have a powder receptacle mounted therein for collecting the powder flowing thereto. In order to empty the powder collection section and the powder receptacle, an access door may be provided in the housing.

Preferably, the powder dispensing system is arranged such that the connection section extends from a wall extending upwardly from a base in the powder dispensing section to an upper portion of the housing of the powder receiving section. Particularly preferred is an embodiment wherein the conduit forms a structural component to thereby support the powder dispensing section.

The powder dispensing section has at least one and preferably several venting apertures formed in a wall of the housing.

A grill may be provided surrounding the air outlet in the housing of the powder receiving section.

BRIEF DESCRIPTION OF THE DRAWINGS

An embodiment of the present invention will now be described, by way of example, in reference to the following drawings in which.

DESCRIPTION OF THE PREFERRED EMBODIMENTS

Figure 1:
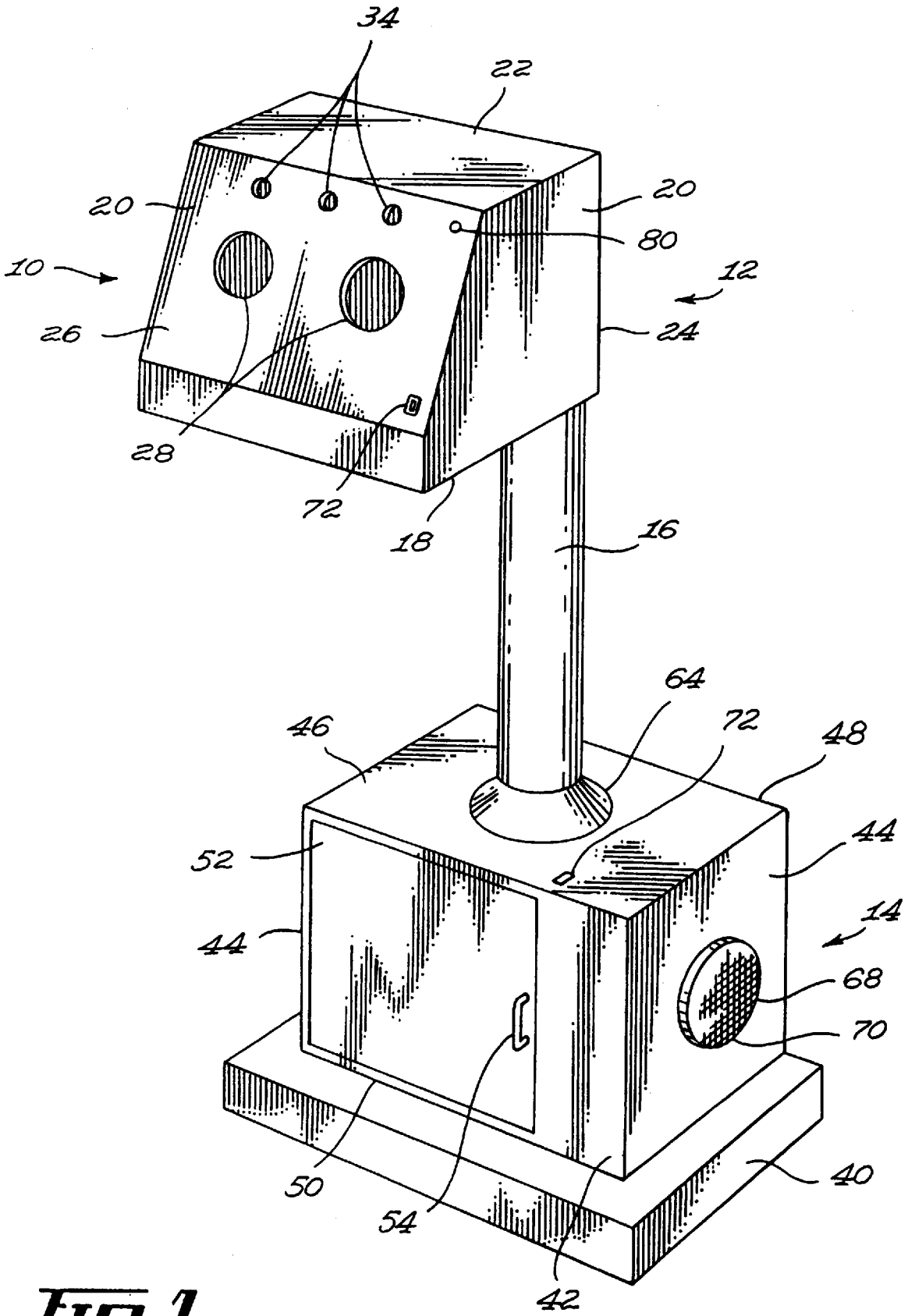
FIG. 1 is a perspective view illustrating a powder dispensing system in accordance with an embodiment of the present invention.

Referring to FIG. 1, there is shown a powder dispensing system 10 in accordance with an embodiment of the present invention. Powder dispensing system 10 includes a powder dispensing section having a dispensing chamber 12 and a powder collection section having a collecting chamber 14.

The collecting chamber 14 is pneumatically coupled to the dispensing chamber 12 by a connecting duct 16. The dispensing chamber 12 has a dispensing chamber bottom wall 18, a pair of dispensing chamber side walls 20, a dispensing chamber top wall 22, a dispensing chamber back wall 24 and an inclined dispensing chamber front wall 26.

Figures 2, 3:
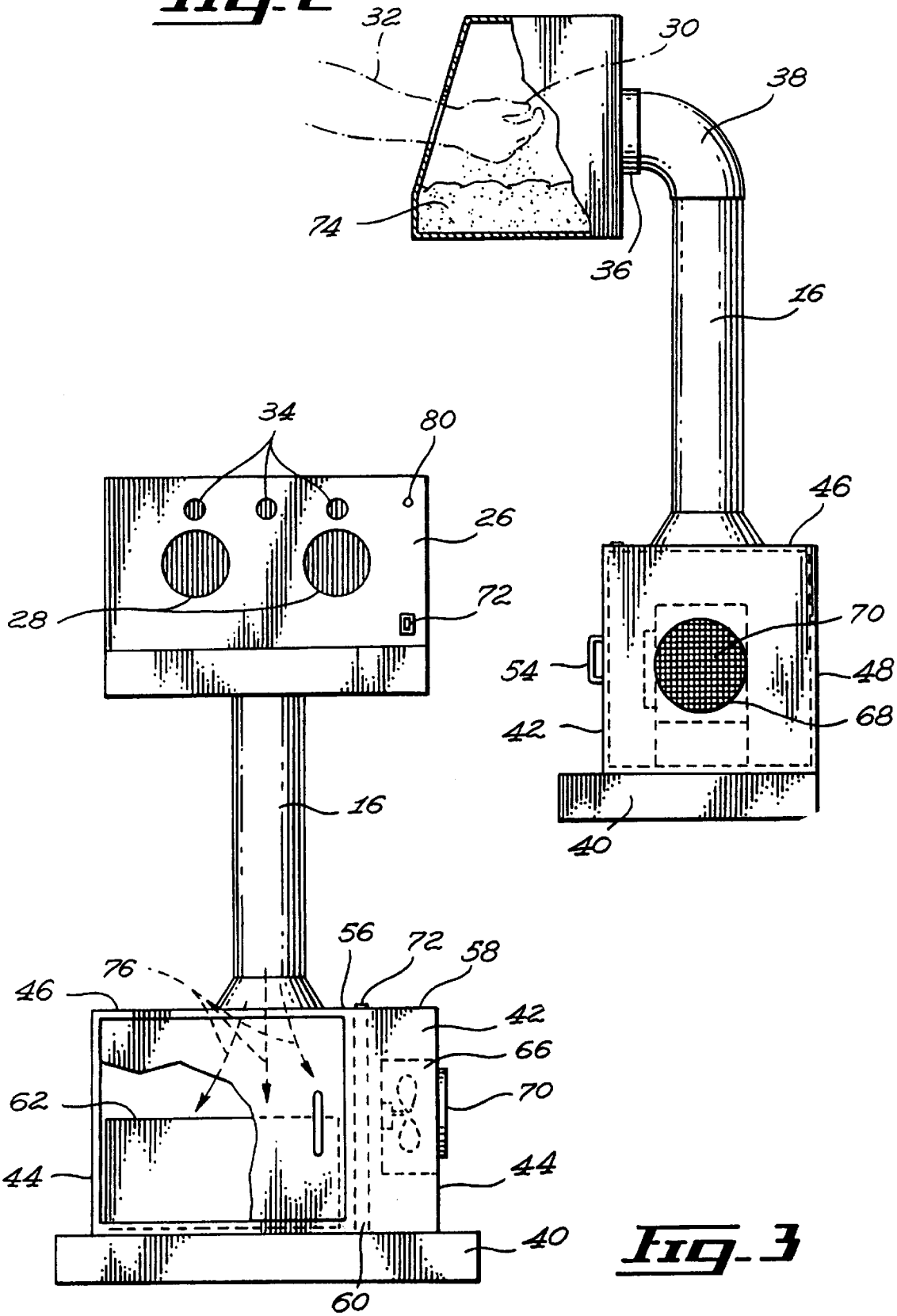
FIG. 2 is a side view with a section taken out illustrating the powder dispensing system of FIG. 1.
FIG. 3 is an elevational view with a section taken out illustrating the powder dispensing system of FIG. 1.

The dispensing chamber front wall 26 is provided with a set of access apertures 28 extending therethrough. The access apertures 28 are configured and sized so as to allow through passage of the hands 30 and a portion of the arms 32 of an intended user as illustrated in FIG. 2. The dispensing chamber front wall 26 is also provided with a set of venting apertures 34 extending therethrough. The venting apertures 34 are adapted to allow through passage of air for reasons which will become hereinafter obvious. The dispensing chamber back wall 24 is provided with a venting aperture 36 extending therethrough. The venting aperture 36 is pneumatically coupled to an arcuate segment 38 part of the connecting duct 16.

The connecting duct 16 is adapted not only to allow passage of air between the dispensing chamber and the connecting duct 16 but also to structurally support the dispensing chamber 12 in a substantially overlying relationship relatively to the collecting chamber 14. The collecting chamber 14 is mounted on a base component 40. The collecting chamber 14 has a collecting chamber front wall 42, a pair of collecting chamber side walls 44, a collecting chamber top wall 46, a collecting chamber back wall 48 and a collecting chamber base wall 50.

The collecting chamber 14 is provided with a hinged door 52 having a door handle 54. The hinged door 52 is adapted to allow access to the interior of the collecting chamber 14.

The collecting chamber 14 defines a collecting area 56 and a filtering area 58 formed therein. The collecting area 56 and the filtering area 58 are partitioned by a filtering plate 60 mounted therein. An open top collecting receptacle 62 is positioned inside the collecting area 56.

The connecting duct 16 is pneumatically connected to a connecting duct aperture 64 formed in the collecting chamber top wall 46. The collecting receptacle 62 is positioned substantially in register with the connecting duct aperture 64. A ventilator means 66 is mounted inside the filtering chamber 58.

An air outlet aperture 68 is formed in one of the collecting chamber side walls 44. The air exhaust aperture 68 preferably has a screen or grill 70 mounted thereacross. An activating switch 72 is mounted on the collecting chamber 14. A visual activation indicator such as a light emitting indicator 80 is preferably mounted on the dispensing chamber 12. The indicating means are adapted to allow an intended user to become aware of the activation of the activating switch 72.

In use, a volume of powderous material 74 such as magnesium powder is nested inside the dispensing chamber 12 as illustrated in FIG. 2. Whenever an intended user wishes to grasp some of the powderous material 74, the intended user activates the switch 72 which is electrically coupled to a power source (not shown) and to the ventilating means 66.

Activation of the ventilating means 66 allows the latter to draw air from the ventilating apertures 34 through the connecting duct 16 into the collecting area 56 through the filter plate 60 and out through the exhaust aperture 68. The air movement indicated by arrows 76 in FIG. 3 thus allows for the excess powder material to be drawn through the connecting duct 16 into the collecting receptacle 62 for recycling of the powderous material. The filtering plate 60 is adapted to prevent the powderous material from escaping through the exhaust aperture 68. Thus, the wastage of powderous material will be reduced and, as well, pollution of the surrounding environment will be minimized.

It will be understood that changes and modifications may be made to the above described embodiment. Thus, for example, one could provide for automatic operation of the fan if so desired. Appropriate sensing means could be mounted to sense when a user inserts his or her hand and automatically commence operation of the fan. When the fan is operated manually, means could be provided for control of the fan speed—i.e. a suitable rheostat could be inserted in the electrical circuit.

The access apertures could, if so desired, be covered with a cover material such as a plurality of flaps which would still permit entry of the user's hand.

I claim:

1. A powder dispensing system comprising a powder dispensing section, a powder collection section, a connecting section extending between said powder dispensing section and said powder collection section, and ventilating means for drawing air from said powder dispensing section to said powder collection section through said connecting section;

said powder dispensing section comprising container means for holding a supply of a powder material;

a housing substantially enclosing said container means;

access means to permit access to said powder material by a user;

said powder collection section comprising a powder receiving area;

a housing substantially surrounding said powder receiving area;

an air outlet in said housing; and filter means associated with said air outlet.

2. The powder dispensing system of claim 1 wherein said ventilating means comprises a fan mounted in said powder collection section proximate said air outlet.

3. The powder dispensing system of claim 2 wherein said access means to permit access to said powder material comprises a pair of apertures each sized to permit the passage of a user's hand therethrough.

4. The powder dispensing system of claim 2 wherein said powder collection section includes a powder receptacle mounted therein.

5. The powder dispensing system of claim 4 wherein said powder collection section includes an access door in said housing to provide access to said powder receptacle.

6. The powder dispensing system of claim 2 wherein said housing enclosing said container means of said powder dispensing section comprises a base having a wall extending upwardly therefrom, said connection section comprising a conduit extending between said wall and an upper portion of said housing of said powder receiving section.

7. The powder dispensing system of claim 6 wherein said conduit forms a structural component, said conduit supporting said powder dispensing section.

8. The powder dispensing system of claim 7 wherein said powder dispensing section has at least one venting aperture formed in said wall of said housing.

9. The powder dispensing system of claim 8 further including a grill surrounding said air outlet in said housing of said powder receiving section.

10. The powder dispensing system of claim 1 wherein said ventilating means comprises a fan mounted in said powder collection section proximate said air outlet, said filter means being interposed between said fan and said powder receiving area.

11. The powder dispensing system of claim 1 further including switch means operative to permit selective operation of said fan.

12. The powder dispensing system of claim 11 further including visual indicating means to indicate when said ventilating is operative.

13. A powder dispensing system comprising a powder dispensing section, a powder collection section, and a connecting section extending between said powder dispensing section and said powder collection section;

said powder dispensing system comprising container means for holding a supply of a powder material;

a housing substantially enclosing said container means; first and second access apertures formed in said housing to permit access to said powder material by a user, each of said access apertures being sized to permit the passage of a user's hand;

said powder collection system comprising a powder receiving area;

a housing substantially surrounding said powder receiving area, an air outlet formed in said housing, a ventilating means mounted proximate said air outlet to blow air drawn from said powder dispensing section outwardly from said housing;

filter means mounted between said fan and said powder receiving area.

* * * * *